US005385497A

United States Patent [19]

Chu

[11] Patent Number: 5,385,497

[45] Date of Patent: Jan. 31, 1995

[54] WATER EXERCISER

[76] Inventor: Jack S. Chu, 18 Elm St., Alhambra, Calif. 91801

[21] Appl. No.: 7,733

[22] Filed: Jan. 22, 1993

[51] Int. Cl.[6] ..... B63C 9/08

[52] U.S. Cl. ..... 441/129; 440/21; 114/352

[58] Field of Search ..... 441/129–132; 440/21; 472/13; 114/61, 352

[56] References Cited

U.S. PATENT DOCUMENTS 1,465,790 8/1923 Ranlett ..... 441/132
2,401,453 6/1946 Bell et al. ..... 114/352
2,745,118 5/1956 Potts et al. ..... 114/61
3,161,897 12/1964 Hill ..... 441/130
4,315,475 2/1982 Echols ..... 441/130
4,973,278 11/1990 Williams ..... 441/131

*Primary Examiner*—Jesus D. Sotelo
*Attorney, Agent, or Firm*—Danton K. Mak

[57] ABSTRACT

Apparatus for supporting the human in water includes floats for resting on the water and a structure for supporting the human. A structure is affixed to the floats and the human can use his feet or fins attached to his feet for moving the apparatus in the water. The floats can be two elongated members spaced to either side of a space for accommodating humans or can be at least partially circular to partially surround the human.

51 Claims, 7 Drawing Sheets 72
186
78
86a
85
77
71
185
187
74
89
91
88
93
179
92
90
81
86
95
94
96
97
98
99
60
63
62
64
66
70
69
65
67
68

WATER EXERCISER

BACKGROUND

Water borne vessels which provide for fun and skill by humans are highly desirable.

This invention relates to a water borne vessel which can be used for fun on water surfaces such as swimming pools, rivers, lakes and the ocean. Additionally, the vessel can be used for challenging activities such as competitive racing.

Many different water borne vessels are known for challenging humans that use the vessels. Such vessels include boats which a human would propel by working oars with his arms. Other water borne vessels which are known use the power of a human foot to operate paddles which turn pedals for propelling the vessel.

In the Applicant's knowledge no vessel is known where the power of a limb, particularly the foot, can be directly or indirectly employed in the water to move or propel the vehicle on water.

The present invention is directed to providing a unique water borne vessel which can be propelled by directly or indirectly using the foot of a human.

SUMMARY

By this invention, there is provided a vessel for supporting a human on water and permitting for the vessel to be moved under action of a moving foot.

According to the invention, apparatus for supporting a human in water includes float means for resting on water. Structure means for supporting the human is affixed to the float means. There are space means in the structure for receiving at least part of limbs of the human or an extension to the limbs for protrusion below the float means. As such, the limbs, preferably the feet of the human, can be used to propel, power and move the float means and structure on water.

In a preferred form of the invention, the float means includes at least two spaced apart elongated floats and the structure means extends between the elongated floats. The structure means includes at least two spaced transversely directed and vertically oriented circular support members with support bars extending between them. The support bars are used for supporting selectively at least one of the forearms, armpits, or hands of the human. In some forms of the invention, a seat is provided to the support bars whereby the human can sit on the structure means while powering the vessel with his feet.

In another preferred form of the invention, the float means includes an at least partly circular construction, and the support means includes two at least partly circular support members. The circular support members are substantially parallel to the float means and are spaced apart and above the float means. There is selectively a seat or support on the support means for supporting the human at least under the arms, on the forearms or with the hands.

Through the space in the support means, there are means for limbs, namely the feet and part of the legs, for the human to protrude into the water whereby the apparatus can be propelled on the water. In some situations, paddles or fins can be attached to the feet so that the paddles or fins assist propulsion of the apparatus on water.

The invention is now further described with reference to the accompanying drawings.

DRAWINGS

FIG. 7 is a rear view of the second embodiment of the invention showing the human located in the space between the support means with feet extending into the water.

DESCRIPTION

Figure 1:
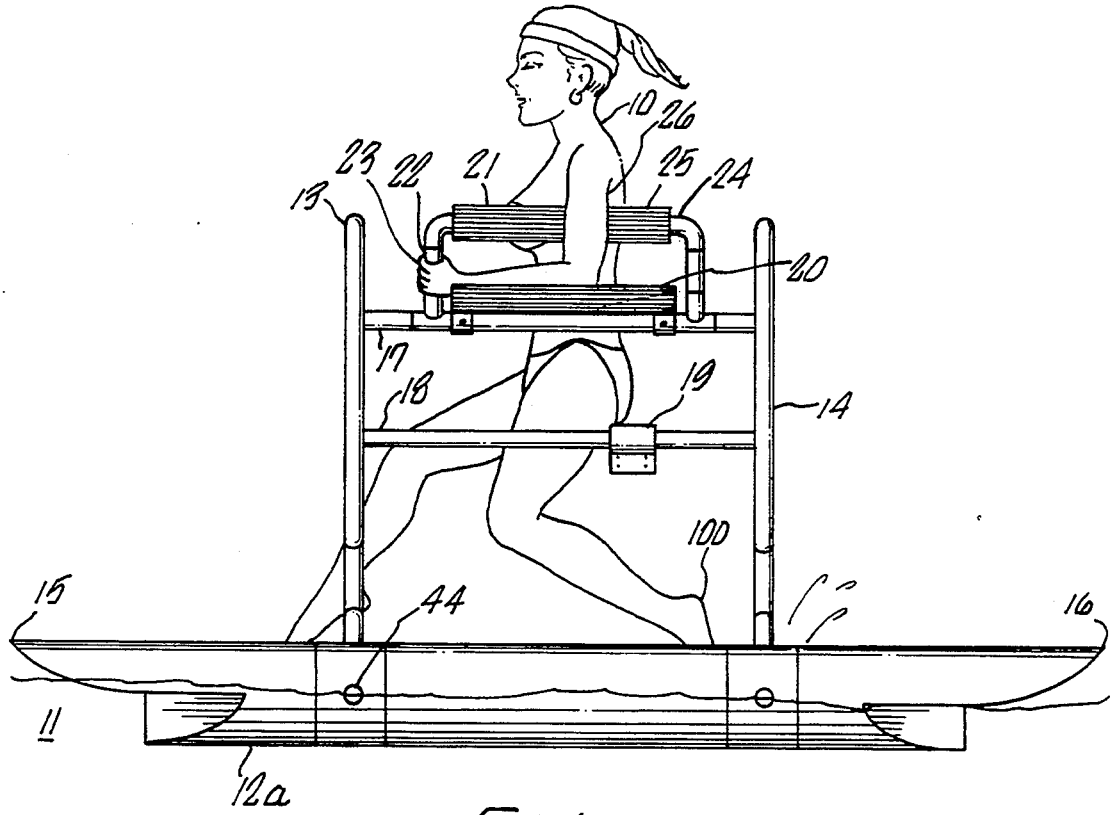
FIG. 1 is a side elevational view of one embodiment of the invention showing a human in position, the embodiment including spaced elongated float means.
Figure 2:
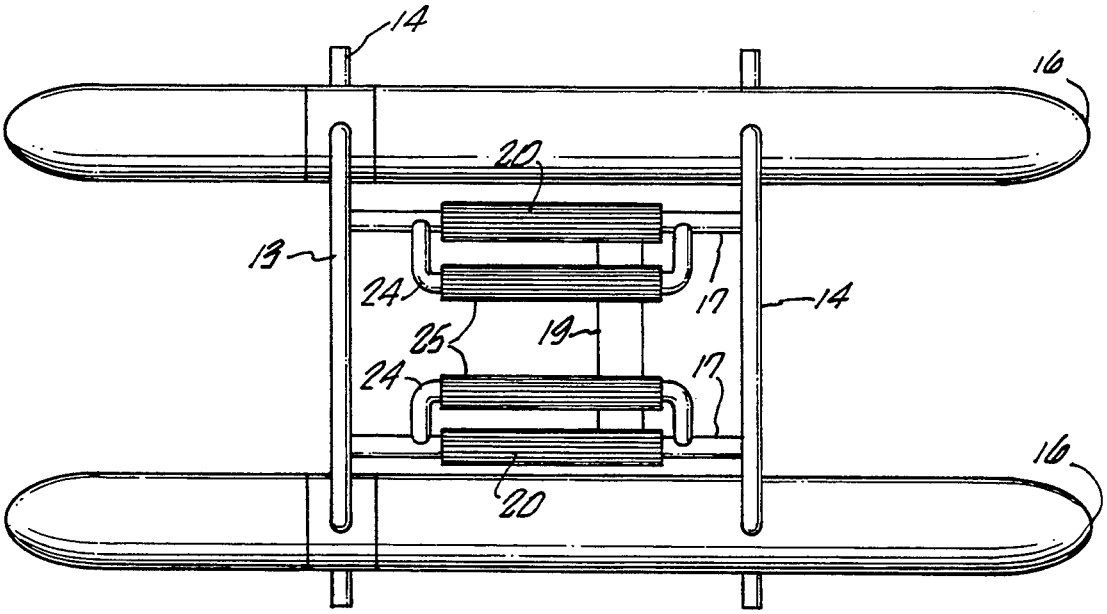
FIG. 2 is a plan view of the embodiment of FIG. 1 as viewed from the top, showing the spaced elongated float means and the support means between the elongated float means.

In a first embodiment, the apparatus for supporting a human 10 on water 11 includes two elongated spaced float means **12*a* and 12*b*. On the float means 12*a* and 12*b* there are support structures 13 and 14 which include two substantially circular frame members which are vertically orientated and spaced apart and transversely located between the floats 12*a* and 12*b***.

Each of the floats **12*a* and 12*b* have their respective leading ends 15 and trailing ends 16. The leading ends 15 and trailing ends 16 are relatively pointed. By this is meant the ends are relatively rounded so as to facilitate movement through water 11. The ends 15 and 16 are thus not blunted to slow movement in the water. Appropriate different shapes can be provided to the leading ends 15 and 16 as is required to facilitate appropriate movement through the water 11**.

Between the circular frame members 13 and 14 there are pairs of elongated bars 17 and 18 which are spaced apart vertically relative to each other. The horizontal pair of bars 18 include a seat 19 on which a human 10 can sit. The seat 19 can be adjustable relatively forwards or backwards relatively between the leading ends 15 and trailing ends 16 of the floats as required.

The pair of bars 17 provide rests 20 for forearms 21 of the human 10. Also provided are grips 22 for hands 23 of the human 10. Additional bars 24 are provided with a sleeve 25 for fitting under the armpits 26 of the human.

The structure means which includes the two substantially and partially circular frame members 13 and 14 also includes two vertically disposed pillars 26 and 27 along with each of the frame members 13 and 14. The bars 17 and 18 are mounted between these respective pillars 26 and 27 on each of the frames 13 and 14 respectively. The lower ends of the pillars 26 and 27 are directed respectively outwardly in a radial direction to have two radially outwardly directed sections 28 and 29.

The approximate radial center for the sections 28 and 29 is the central axis for the circular frame members 13 and 14 respectively. The sections 28 and 29 extend outwardly approximately to the line of a vertical tangent from the points 30 and 31 respectively of the circular frame members 13 and 14. At such positions, there are two downwardly directed stubs 32 and 33 which are arranged to join with the float means 12*a* and 12*b*. The central axis of the stubs 32 and 33 will be substantially along the diametrical line running through the float means 12*a* and 12*b* respectively.

Figure 4A:
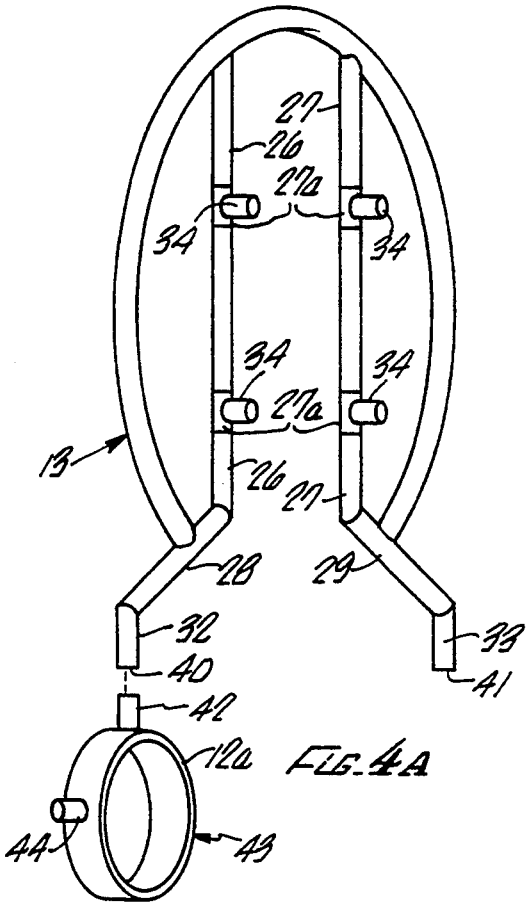
FIGS. 4A, 4B, 4C, 4D and 4N illustrate different components of the embodiment of FIG. 1, namely the structure means and float means in the separated form.
Figure 4B:
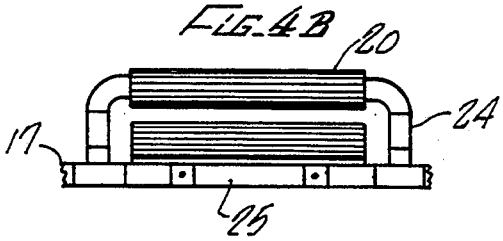
Figure 4C:
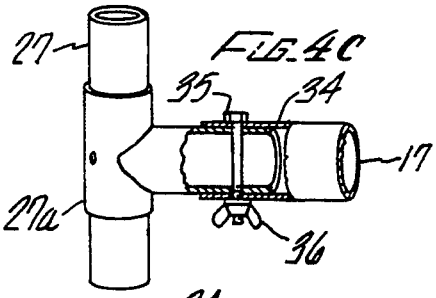
Figure 4N:
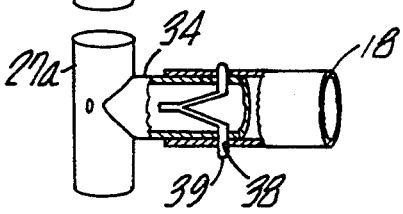

The structure frame means 13 and 14 are made of separable component parts. As illustrated in FIG. 4A, a first component part includes the partially circumferential frame 13, the upright frame members 26 and 27, the diametrically directed radial sections 28 and 29 and the vertical stubs 32 and 33. From the vertical frame members 26 and 27, there are horizontally directed projections 34. Each projection 34 includes a collar 27*a* which surrounds the rods 26 and 27 so that they are vertically adjustable. In this manner, the frame members 17 and 18 can also be adjusted vertically for different human sizes. This is one manner of adjusting the length of the seat 81. These are directed to engage respectively with hollow bars which form the respective horizontal frame members 17 and 18, as indicated in FIG. 4C. Different connector means are shown to join the stubs 34 and 17. The components 26, 28 and 32 on the one hand, and the components 27, 29 and 33 on the other hand, are each formed from a continuous single element.

In one embodiment, a bolt 35 with a wing nut 36 is used. In a second manner retractable pins 38 are used which fit through apertures 39. The free ends 40 and 41 of the vertical stubs 32 and 33 respectively mate with vertical stubs 42 attached to a circular connector 43. The interengagement of the vertical stubs 32 and 33 with the connector stub 42 is similar to the arrangement shown in FIG. 4C. The circular connector 43 also includes horizontally directed stub 44 which is directed outwardly with respect to each of the elongated floats 12*a* and 12*b*. In some cases, stub 44 can be removed where not in use.

Figure 4D:
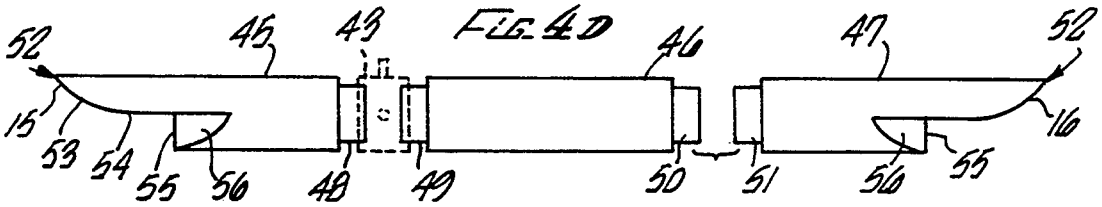
Figure 4E:
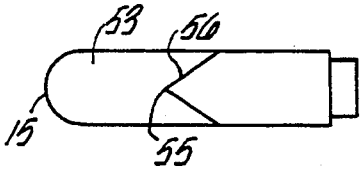
FIG. 4E represents an underview of a leading portion of a float.
Figure 4F:
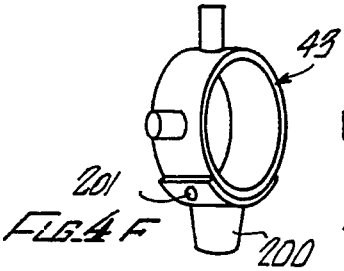
FIGS. 4F and 4G represent an oblique view and an end view of rings for joining components of a float, where there is a recoverable rudder.

In FIG. 4D, an exemplary float 12*a* is illustrated shown in three component parts 45, with the leading end 15, a central portion 46 and a trailing portion 47 with the trailing end 16. The rings 43 fit on collars 48 and 49 between portions 46 and 49 and collars 50 and 51 between portions 46 and 47. This fitting engagement can be a friction fit or a suitable locking mechanism can be used to secure the positive engagement to thereby create each of the floats 12*a* and 12*b*. The leading end 15 and trailing end 16 have a respective pointed top section 52 which curves downwardly through section 53 to a position substantially parallel and axially directed along line 54 of each of the elongated floats 12*a* and 12*b*. Inset from the point 52, the bottom half portion of the floats 12*a* and 12*b* have a vertically directed pointed section 55 which tapers through sections 56 remotely from the edges 54. The central portion 46 is circular in cross-section. The front portion 45 and the trailing portion 47 have similar cross-sections with a form to facilitate streamlined motion through the water.

In the second embodiment of the apparatus as illustrated in FIGS. 5–8D, there is provided a float means 60 which is partially circular, to the extent of about 270° about a vertical axis 61. The float means 60 is an inflatable rubber tube 62 which is partially circular to adopt an inflated position 63 which is similarly partly circular. The ends 64 and 65 of the inner tube 62 meet with spherical sections 66 and 67 and as illustrated in FIG. 8E, a pump 68 is used through a valve connector 69 to inflate the tube 62 and the spherical sections 66 and 67. Inflated positions 70 are shown. When the float means 60 is deflated, it is easier to assemble and disassemble through rings 90, 91, 92 and 94. When inflated, the float means 60 cooperates with the rings 90, 91, 92, and 94 to provide a stable structure.

Above the float means 60, there are located two spaced circumferential sections 71 and 72 which are respectively parallel to the horizontal position adopted by the float means 60. The diameter of the sections 71 is substantially equal to the diameter defined by the midpoint diameter of the float means 60. The diameter of the circular sections 72 is inwardly directed relative to the inside diameter lines 73 of the inner tube 60. Between the circumferential sections 71 and 72, there is a frame member 73 which has vertically directed stubs 74 for anchorage with the float means through rings 75. At the top end 76 of the stub, there is an inwardly tapered stub section 77 which meets with the vertical stub 78 which at its top end 79 meets with the circular frame section 72. Extending at about the juncture between sections 77 and 78, there are two horizontal bars 79 and 80 respectively on either side of the vertical axis 61.

Between the bars 79 and 80, there is located a seat section 81 for the human 82. The human 82 gains access to the vessel through the space 83 between the ends of the spherical sections 70 of the float means 60. The space for the human 82 in the structure defined by the frame members 71 and 72 for accommodating the feet limbs of the human 82 is defined by the space 84 which extends inside of the frame members 71 and 72 and float 60. If desired, a suitable footrest can be provided, depending from the structure 71. Alternatively, the human 82 can rest his feet 83 on the circumferential structure 71 or the float 60. The human 82 can use the hand grip 85 which is built on to horizontal bars which extend between the upright pillars 78. The horizontal bars 86 will provide additional stability to the structure. The footrest is constituted by the horizontal bar 179 extending across the partially circumferential frame 71 of the structure means.

Figures 8A, 8B, 8C, 8D, 8E:
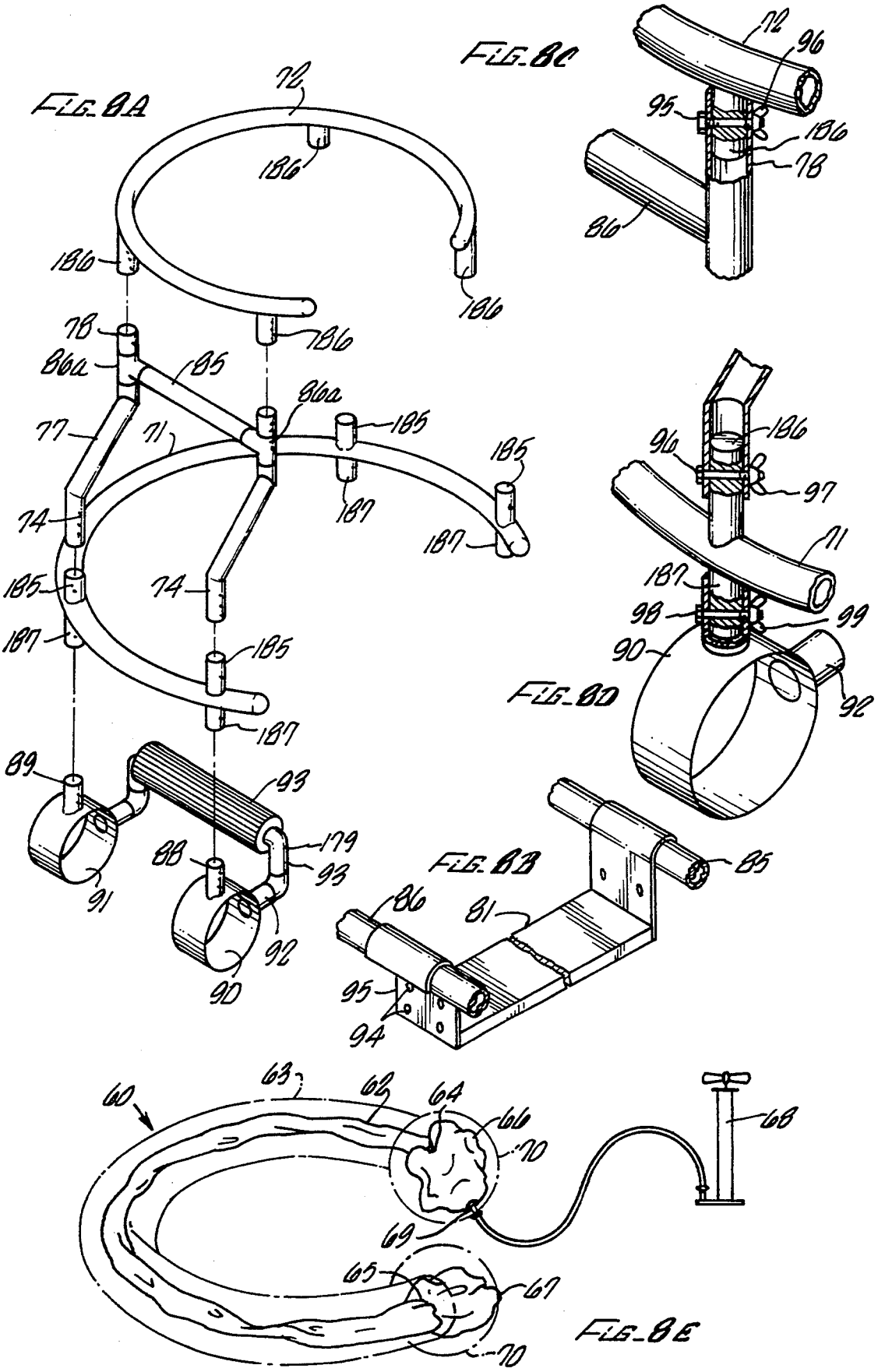
FIGS. 8A, 8B, 8C, 8D and 8E are component parts of the apparatus of the second embodiment, the component parts being illustrated in separate in position.

As illustrated in FIG. 8A, the structure means is defined of multiple separable components. The circular frame section 71 is separable from the circular frame section 72. The structure means portion of the frame separating the circular portions 71 and 72 and which includes the stubs 74 greatly inwardly directed portions 77 and stub 78 is separable and the free ends of 74 and 78 meet with stub portions 185 extending upwardly from the frames 71 and 186 extending downwardly from the frame 72. The frame 71 also includes downwardly directed stubs 187 which meet with stubs 88 and 89 which extend upwardly from collars 90 and 91 respectively. The collars 90 and 91 are for engagement about the float means 60. The collar 90 also includes a horizontally extending stub 92 for engagement with a downwardly depending member 93 from each of the footrest horizontal bars 179 and 180 respectively. A padded section 93 is provided over the horizontally extending bars 179 and 180 for the footrest.

In FIG. 8A, the frame members 78, 77 and 74 are formed as a single piece.

As illustrated in FIG. 8B, the seat 81 depends from the horizontal bars 85 and 86. Adjustment positions are shown by spaced apertures 94 on downwardly directed support panels 95. The seat 81 can also be moved relatively rearwardly and forwardly along the bars 85 and 86. The bars 85 and 86 are vertically adjustable on bars 78 by having the ends of bars 85 and 86 include T-piece collars **86*a* which can ride adjustably vertically on bars 78. The collars 86*a* can be fixed in any desired vertical location thereby to adjust the height of the seat 81**.

In FIG. 8C, the stub 186 depending from the circular section 72 engages with the upright rod portion 78 through a bolt 95 and wing nut 96.

In FIG. 8D, the interaction of the circular section 71 with stubs 185 and 187 respectively is shown with bolt 96 and wing nut 97 respectively with the stub 185 and bolt 98 and wing nut 99 with stub 187.

As illustrated in FIGS. 1–4D, stubs 44 extend outwardly and sideways from the elongated floats **12*a* and 12*b*. In this manner, adjacent vessels can be located in tandem and in side-by-side relationship with the side stubs 44 interengaging with side stubs 44** of an adjacent vessel. In other situations, a construction can be configured where the float between two adjacent side-by-side vessels is common to both vessels. Other configurations also include a situation where extension bars can be provided forwardly or rearwardly so that a tandem construction can be created where the vessels are configured in front-to-back relationship in tandem.

Figure 9:
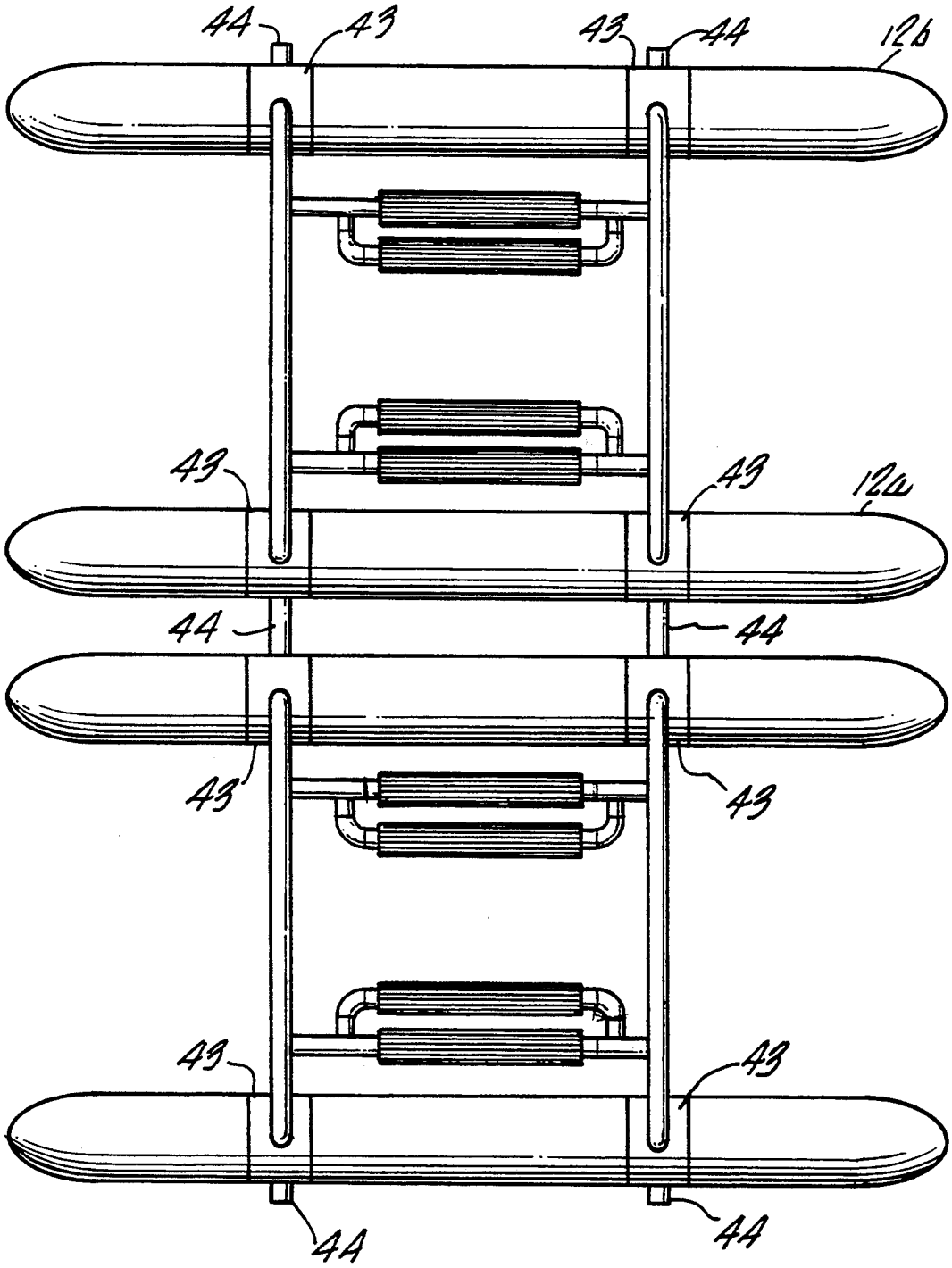
FIG. 9 illustrates a top plan view of the apparatus in side-by-side tandem relationship.

In FIG. 9, the apparatus is disclosed in tandem side-by-side relationship with the rings 43 connected by a common rod 44 between adjacent side-by-side floats 12 and **12*b*** of each apparatus.

Figure 10A:
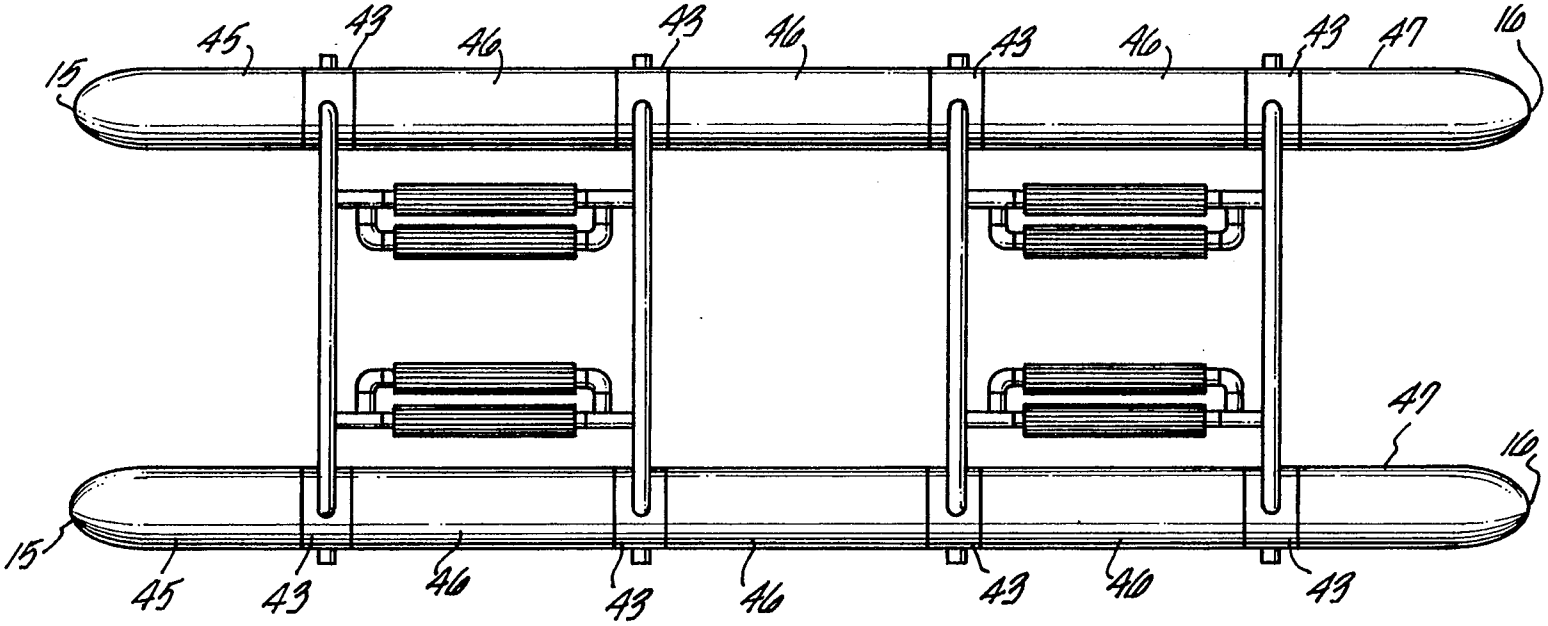
FIG. 10A illustrates a top plan view of the apparatus in end-to-end tandem relationship.
Figure 10B:
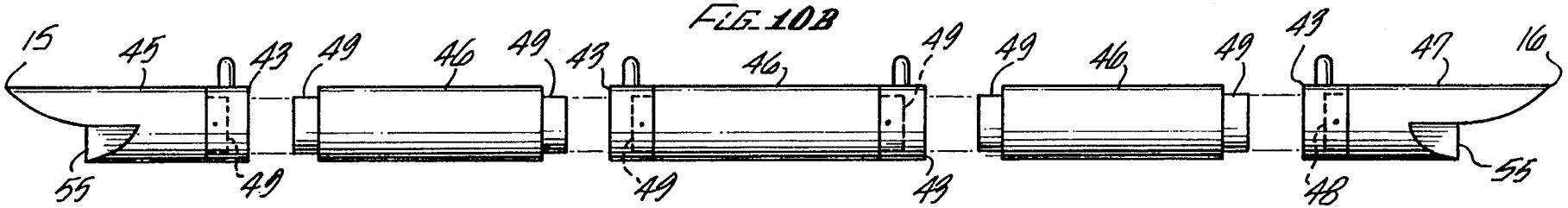
FIG. 10B is a side view of a float where there are three central components and a leading component and a trailing component.

In FIG. 10A, an end-to-end tandem relationship is shown. Each float has five components in end-to-end relationship. There is a leading component 45, three central components 46 and a trailing component 47. Rings 43 are connected between each of the components 45, 46, and 47. The different components are illustrated in separated fashion in FIG. 10B.

Figure 3:
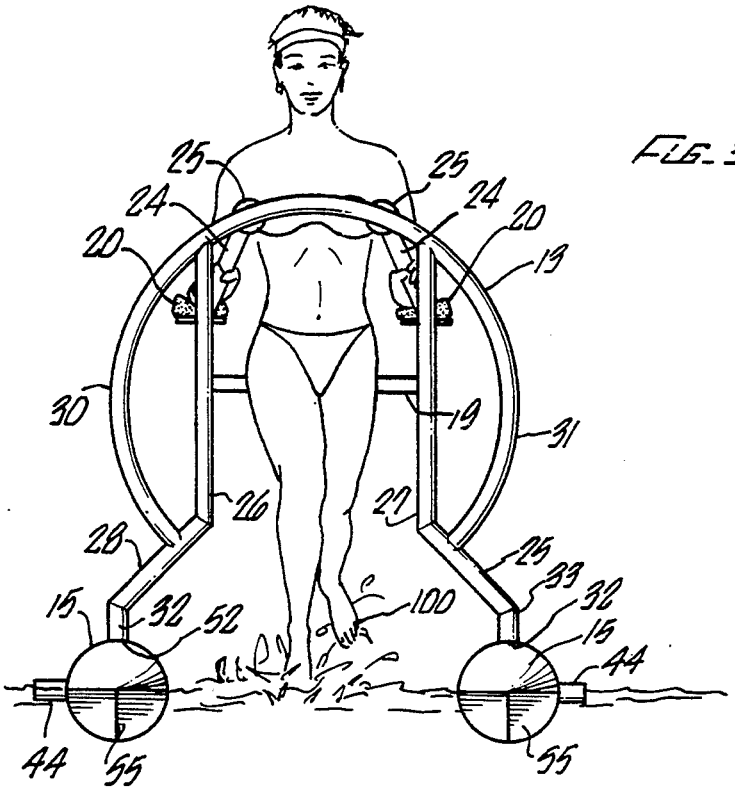
FIG. 3 is an end view from the front of the embodiment of FIG. 1.
Figure 5:
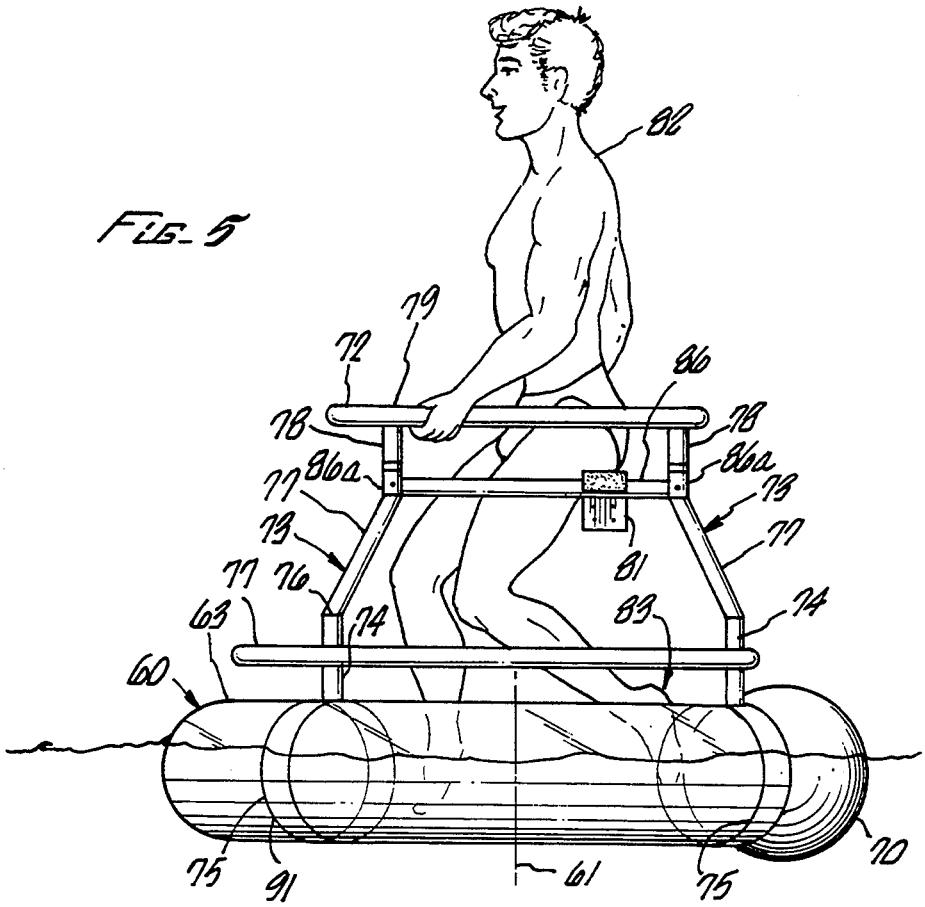
FIG. 5 is a side elevation illustrating a second embodiment of the invention using a substantially circular float means and the human located in the space in the float means.
Figure 6:
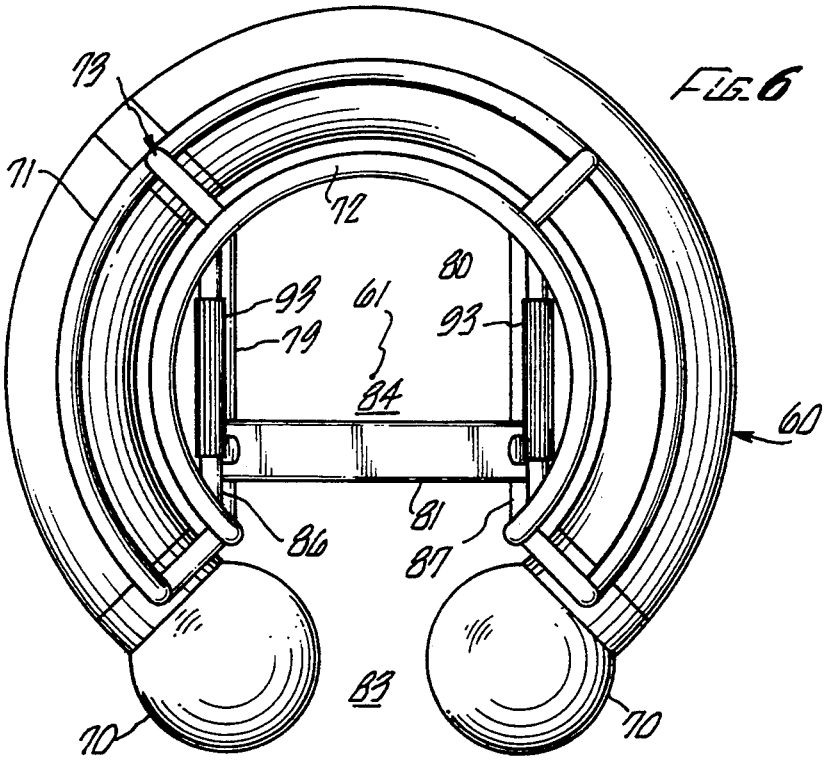
FIG. 6 is a top elevation of the second embodiment of the invention showing the substantially circular float means and the support means above the float means.

Many other forms of the invention exist, each differing from the other in matters of detail only. The limbs of the human 10 or 82 illustrated provide the mode of power to the vessel. As indicated in FIGS. 5–7, these are the feet 83. .The feet 100 are indicated in FIGS. 1 and 3. It is possible for the human 10 or 82 respectively to wear paddles or fins on their respective feet 83 or 100 to assist the motion and propulsion of the vessel on water.

Although the float means **12*a* and 12*b* and 60** are shown to be substantially circular in cross-section, it is possible for the floats to have any other desirable cross section such as any appropriate polygonal shape, such as triangular, rectangular or other multi-sided shape. Any other oval, curved or flat configuration could also be appropriate. The leading end and/or trailing end may be a combination of one or more related cross-sections and flat or curved sections. The floats may be solid or hollow, partially inflated or fully inflated, as desired. The appropriate buoyancy needs to be provided relative to the structure and the human riding the vessel. The structure means can be suitably configured in with plastic PVC piping or other desirable construction medium.

Although the invention has been described in the sense of a water exerciser device, it will have uses in life saving circumstances. A person in distress in water can easily mount on the floats, and by using his feet he can power the vessel to safety.

In other cases, the vessel can have floats which are flat or especially curved to facilitate surfing on water, such as ride action of waves on the ocean. In this sense, the vessel can be considered a double surfboard with a structure connection to separate hulls. This can enhance the balance.

Figure 4G:
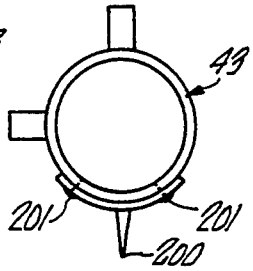
Figure 4H:
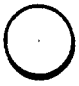
FIGS. 4H to 4M are cross-sectional views of different float configurations, being a circular shape, semicircular shape, triangular, rectangular, hexagonal and oval, respectively.
Figure 4I:
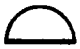
Figure 4J:
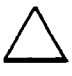
Figure 4K:
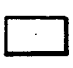
Figure 4L:
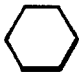
Figure 4M:
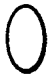
Figure 1:
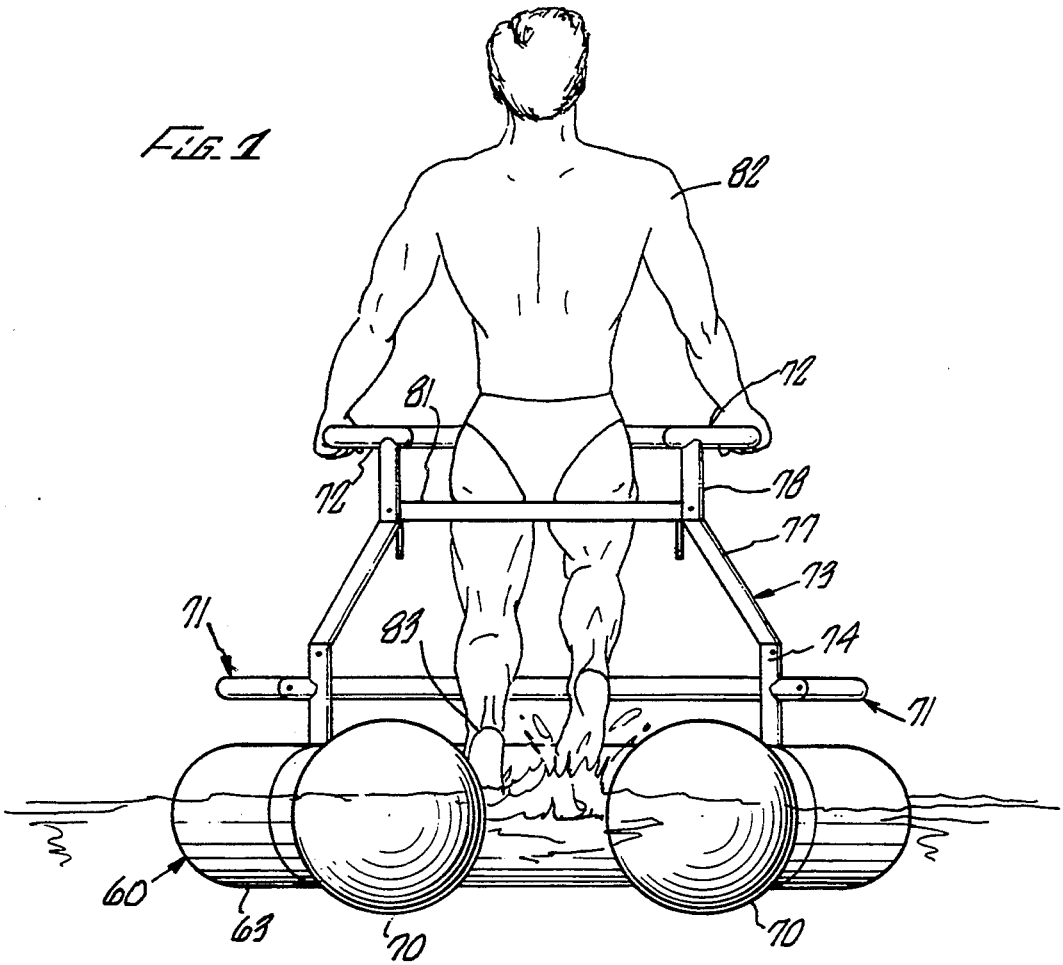

In other different situations, one or more rudders can be used in spaced relationship to protrude from the bottom of the floats. The rudders may be movable or fixed. This construction is illustrated in FIGS. 4G and 4G where a rudder 200 is shown connected by screw means 201 to the ring 43.

The floats **12*a* are formed of a closed cell frame with fiberglass on the outside. The frame structures are constructed of rigid PVC material, aluminum or other lightweight material. The material 62 can be of rubber, plastic or other suitable inflatable material. In the embodiments illustrated in the Figures with an inflatable member 62** rigidity of the overall structure is provided by the superstructure rigid framework.

By the invention, the superstructure supports the upper body portion of the person, the relay rendering the feet and legs, at least in part, free to interact with the water. By not having the person tethered or enclosed to the vessel, a person can freely leave the vehicle, should a distress situation arise.

The scope of the invention is to be determined solely in terms of the following claims.

I claim:

1. Apparatus for supporting a human on water comprising:

float means for resting on water, the float means including at least two spaced apart elongated floats, structure means for supporting a human, the structure means being affixed to the float means and being for receiving a human, and spaced means in the structure means for receiving at least part of a limb of the human for protrusion below the float means, such that the limb can be used for moving the float means and structure means on water, each elongated float including a leading end and a trailing end, the leading end and trailing end being relatively pointed thereby to facilitate movement through the water and wherein each elongated float includes multiple, separable components and including means for securing the structure means to at least one of the components of each of the elongated floats, wherein the structure means includes an at least partially circular frame member for surrounding at least part of the human.

2. Apparatus as claimed in claim 1 wherein the structure means includes means for locating the human on the structure means.

3. Apparatus as claimed in claim 1 wherein the limb of the human includes a foot for protrusion through the float means.

4. Apparatus as claimed in claim 1 wherein the structure means is directed vertically and transversely between the spaced float means, the support means including at least two partially circular frames, the frames being spaced apart, and elongated bar means extending between the spaced apart frames, the elongated bar means being for supporting the human.

5. Apparatus as claimed in claim 1 wherein the float means is at least partially inflatable.

6. Apparatus as claimed in claim 1 wherein the float means is partly circularly disposed in a horizontal plane, and the structure means includes substantially circular frame members located parallel with the plane of the float means, the frame members being spaced above the float means, and there being at least two substantially circular frame members directed in a spaced planar relationship relative to the float means, and including spaced bar means directed between the spaced circular frame members.

7. Apparatus as claimed in claim 6 wherein the spaced circular frame members are arranged such that a first circular support is located substantially adjacent and above the float means and has a diameter substantially between an inner diameter and outer diameter of the circular float means, and wherein a second circular frame member is spaced above the first support and has a diameter less than the inner diameter of the float means.

8. Apparatus as claimed in claim 1 wherein the structure means includes upstanding frame members for accommodating a human.

9. Apparatus as claimed in claim 1 wherein the structure means includes substantially horizontally extending bars for supporting a human under the armpits of the human.

10. Apparatus as claimed in claim 1 wherein the structure means includes means for supporting a forearm of the human.

11. Apparatus as claimed in claim 1 wherein the structure means includes means for supporting a hand of the human.

12. Apparatus as claimed in claim 1 wherein the structure means is separable from the float means, and the structure means includes multiple separable component parts thereby to facilitate assembly and disassembly of the structure means and of the structure means with the float means.

13. Apparatus including means for adjoining multiple apparatus of claim 1 in tandem relationship, the tandem relationship being in at least one of a back-to-front or side-by-side formation.

14. Apparatus as claimed 13 wherein the means for adjoining multiple structures in tandem relationship selectively employs a common float means.

15. Apparatus as claimed in claim 1 wherein the float means includes a selected polygonal cross-sectional shape.

16. Apparatus for supporting a human on water comprising:

float means for resting on water, the float means including at least two spaced apart elongated floats, structure means for supporting a human, the structure means being affixed to the float means and being for receiving a human and including means for supporting the human on at least one of the seat of the human, the forearms, the hands, the armpits of the human, and spaced means in the structure means including upstanding frame members for receiving at least part of the feet of the human for protrusion below the float means, such that the feet can be used for moving the float means and structure means on water, wherein the structure means is directed vertically and transversely between the spaced float means, the support means including at least two partially circular frames, the frames being spaced apart, and elongated bar means extending between the spaced apart frames, the elongated bar means being for supporting the human.

17. Apparatus as claimed in claim 16 wherein each elongated float includes multiple, separable components and including means for securing the structure means to at least one of the components of each of the elongated floats.

18. Apparatus for supporting a human on water comprising:

float means for resting on water, the float means including at least two spaced apart elongated floats, the float means extending in at least a partly circular manner about a central axis, such axis being vertically disposed, structure means for supporting a human, the structure means being affixed to the float means and being for receiving a human and including means for supporting the human on at least one of the seat of the human, the forearms, the hands, the armpits of the human, and spaced means in the structure means including upstanding frame members for receiving at least part of feet of the human for protrusion below the float means, such that the feet can be used for moving the float means and structure means on water.

19. Apparatus as claimed in claim 18 wherein the floats include multiple, separable components and including means for securing the structure means to at least one of the components of the floats.

20. Apparatus as claimed in claim 18 wherein the float means is partly circularly disposed in a horizontal plan, and the structure means includes substantially circular frame members located parallel with the plane of the float means, the frame members being spaced above the float means, and there being at least two substantially circular frame members directed in a spaced planar relationship relative to the float means, and including spaced bar means directed between the spaced circular frame members.

21. Apparatus for supporting a human on water comprising:

float means for resting on water, the float means including at least two spaced apart elongated floats, the float means extending in at least a partly circular manner about a central axis, such axis being vertically disposed, structure means for supporting a human, the structure means being affixed to the float means and being for receiving a human and including means for supporting the human on at least one of the seat of the human, the forearms, the hands, the armpits of the human, and spaced means in the structure means including upstanding frame members for receiving at least part of an extension to the feet of the human for protrusion below the float means, such that the feet can be used for moving the float means and structure means on water.

22. Apparatus for supporting a human on water comprising:

float means for resting on water, the float means being at least partly circular and the float means being a tubular structure extending in a circular manner, forming an incomplete circle, at least about 270° about a central axis, such axis being vertically disposed, with the two free ends of the tubular structure ending in bulbous enclosures, with such enclosures each having a cross-sectional dimension larger than the cross-sectional dimension of the tubular structure, when both cross-sections are taken in a plane containing the axis, structure means for supporting a human, the structure means being affixed to the float means and being for receiving a human, and spaced means in the structure means such that a human limb can be used for moving the float means and structure means on water.

23. Apparatus for supporting a human on water comprising:

float means for resting on water, the float means including at least two spaced apart elongated floats, structure means for supporting a human, the structure means being affixed to the float means and being for receiving a human, wherein the structure means is directed vertically and transversely between the spaced floating means, the support means including at least two partially circular frames, the frames being spaced apart, and elongated bar means extending between the spaced apart frame, the elongated bar means being for supporting the human, and spaced means in the structure means such that a human limb can be used for moving the float means and structure means on water.

24. Apparatus as claimed in claim 23 wherein each elongated float includes a leading end and a trailing end, the leading end and trailing end being relatively pointed thereby to facilitate movement through the water.

25. Apparatus as claimed in claim 23 wherein each elongated float includes multiple, separable components and including means for securing the structure means to at least one of the components of each of the elongated floats.

26. Apparatus as claimed in claim 23 wherein the float means is at least partially inflatable.

27. Apparatus as claimed in claim 23 wherein the float means is at least partly circular.

28. Apparatus as claimed in claim 27 wherein the float means is a tubular structure extends in a circular manner, forming an incomplete circle, at least about 270° about a central axis, such axis being vertically disposed, with the two free ends of the tubular structure ending in bulbous enclosures, with such enclosures each having a cross-sectional dimension larger than the cross-sectional dimension of the tubular structure, when both cross-sections are taken in a plane containing the axis.

29. Apparatus as claimed in claim 23 wherein the structure means includes an at least partially circular frame member for surrounding at least part of the human.

30. Apparatus as claimed in claim 23 wherein the float means is partly circularly disposed in a horizontal plan, and the structure means includes substantially circular frame members located parallel with the plane of the float means, the frame members being spaced above the float means, and there being at least two substantially circular frame members directed in a spaced planar relationship relative to the float means, and including spaced bar means directed between the spaced circular frame members.

31. Apparatus as claimed in claim 30 wherein the spaced circular frame members are arranged such that a first circular support is located substantially adjacent and above the float means and has a diameter substantially between an inner diameter and outer diameter of the circular float means, and wherein a second circular frame member is spaced above the first support and has a diameter less than the inner diameter of the float means.

32. Apparatus as claimed in claim 23 wherein the structure means includes upstanding frame members for accommodating a human.

33. Apparatus as claimed in claim 23 wherein the structure means includes substantially horizontally extending bars for supporting a human under the armpits of the human.

34. Apparatus as claimed in claim 23 wherein the structure means includes means for supporting a forearm of the human.

35. Apparatus as claimed in claim 23 wherein the structure means includes means for supporting a hand of the human.

36. Apparatus as claimed in claim 23 wherein the structure means is separable from the float means, and the structure means includes multiple separable component parts thereby to facilitate assembly and disassembly of the structure means and of the structure means with the float means.

37. Apparatus including means for adjoining multiple apparatus of claim 23 in tandem relationship, the tandem relationship being in at least one of a back-to-front or side-by-side formation.

38. Apparatus for supporting a human on water comprising:

float means for resting on water, structure means for supporting a human, the structure means being affixed to the float means and being for receiving a human and including means for supporting the human on at least one of the seat of the human, the forearms, the hands, under the armpits of the human, wherein the structure means is directed vertically and transversely between the spaced floating means, the support means including at least two partially circular frames, the frames being spaced apart, and elongated bar means extending between the spaced apart frame, the elongated bar means being for supporting the human, and spaced means in the structure means such that the feet can be used for moving the float means and structure means on water.

39. Apparatus for supporting a human on water comprising:

float means for resting on water, the float means including at least two spaced apart elongated floats, the float means extending in at least a partly circular manner about a central axis, such axis being vertically disposed, structure means for supporting a human, the structure means being affixed to the float means and being for receiving a human and including means for supporting the human on at least one of the seat of the human, the forearms, the hands, under the armpits of the human, and spaced means in the structure means for receiving at least part of feet of the human, such that the feet can be used for moving the float means and structure means on water, wherein the float means includes multiple, separable components and including means for securing the structure means to at least one of the components of the floats.

40. Apparatus for supporting a human on water comprising:

float means for resting on water, the float means including at least two spaced apart elongated floats, the float means extending in at least a partly circular manner about a central axis, such axis being vertically disposed, structure means for supporting a human, the structure means being affixed to the float means and being for receiving a human and including means for supporting the human on at least one of the seat of the human, the forearms, the hands, under the armpits of the human, and spaced means in the structure means for receiving at least part of feet of the human, such that the feet can be used for moving the float means and structure means on water, wherein the float means is partly circularly disposed in a horizontal plan, and the structure means includes substantially circular frame members located parallel with the plane of the float means, the frame members being spaced above the float means, and there being at least two substantially circular frame members directed in a spaced planar relationship relative to the float means, and including spaced bar means directed between the spaced circular frame members.

41. Apparatus for supporting a human on water comprising:

float means for resting on water, the float means including at least two spaced apart elongated floats, structure means for supporting a human, the structure means being affixed to the float means and being for receiving a human, and spaced means in the structure means for receiving at least part of a limb of the human for protrusion below the float means, such that the limb can be used for moving the float means and structure means on water, each elongated float including a leading end and a trailing end, the leading end and trailing end being relatively pointed thereby to facilitate movement through the water and wherein each elongated float includes multiple, separable components and including means for securing the structure means to at least one of the components of each of the elongated floats, wherein the float means is partly circularly disposed in a horizontal plane, and the structure means includes substantially circular frame members located parallel with the plane of the float means, the frame members being spaced above the float means, and there being at least two substantially circular frame members directed in a spaced planar relationship relative to the float means, and including spaced bar means directed between the spaced circular frame members.

42. The apparatus of claim 41 wherein the structure means includes means for locating the human on the structure means.

43. The apparatus of claim 41 wherein the limb of the human includes a foot for protrusion through the float means.

44. The apparatus of claim 41 wherein the float means is at least partially inflatable.

45. The apparatus of claim 41 wherein the structure means is directed vertically and transversely between the spaced float means, the support means including at least two partially circular frames, the frames being spaced apart, and elongated bar means extending between the spaced apart frame, the elongated bar means being for supporting the human.

46. The apparatus of claim 41 wherein the spaced circular frame members are arranged such that a first circular support is located substantially adjacent and above the float means and has a diameter substantially between an inner diameter and outer diameter of the circular float means, and wherein a second circular frame member is spaced above the first support means and has a diameter less than the inner diameter of the float means.

47. The apparatus of claim 41 wherein the structure means includes upstanding frame members for accommodating a human.

48. The apparatus of claim 41 wherein the structure means includes substantially horizontally extending bars for supporting a human under the armpits of the human.

49. The apparatus of claim 41 wherein the structure means includes means for supporting a forearm of the human.

50. The apparatus of claim 41 wherein the structure means includes means for supporting a hand of the human.

51. The apparatus of claim 41 wherein the structure means is separable from the float means, and the structure means includes multiple separable component parts thereby to facilitate assembly and disassembly of the structure means and of the structure means with the float means.

* * * * *